United States Patent [19]

Lane et al.

[11] Patent Number: 4,624,771

[45] Date of Patent: Nov. 25, 1986

[54] FLUID CATALYTIC CRACKING OF VACUUM RESIDUUM OIL

[75] Inventors: Philip A. Lane, Port Arthur; Charles H. Schrader, Groves; Glenn A. Clausen, Nederland; David E. Self, Port Neches, all of Tex.

[73] Assignee: Texaco Inc., White Plains, N.Y.

[21] Appl. No.: 777,146

[22] Filed: Sep. 18, 1985

[51] Int. Cl.[4] ..... C10G 11/18; C10G 51/02

[52] U.S. Cl. ..... 208/74; 208/75; 208/113

[58] Field of Search ..... 208/74, 75, 113, 76, 208/77

[56] References Cited

U.S. PATENT DOCUMENTS

| | | | |
|---|---|---|---|
| 3,847,793 | 11/1974 | Schwartz et al. | 208/70 |
| 4,147,617 | 4/1979 | Nace | 208/74 |
| 4,218,306 | 8/1980 | Gross et al. | 208/120 |
| 4,419,221 | 12/1983 | Castagnos et al. | 208/113 |
| 4,422,925 | 12/1983 | Williams et al. | 208/75 |

*Primary Examiner*—Brian E. Hearn
*Assistant Examiner*—O. Chaudhuri
*Attorney, Agent, or Firm*—Jack H. Park; Kenneth R. Priem; Richard A. Morgan

[57] ABSTRACT

A mixture of hydrocarbons consisting of gas oil and residual oil is catalytically cracked in the presence of a fluidized zeolite catalyst. The mixture of hydrocarbons is classified by boiling range as a 550°-1000° F. gas oil and a 1000+° F. vacuum residuum. The gas oil is selectively cracked using a freshly regenerated fluid zeolite catalyst having less than 0.1 wt % residual carbon to give a high yield of desirable liquid hydrocarbon boiling from about 60°-670° F. The vacuum residuum is injected into the riser reactor at a point near the riser outlet to quench the cracking reactions in the gas oil. The vacuum residuum undergoes a small amount of reaction removing undesirable materials and yielding a liquid hydrocarbon boiling up to about 1000° F. The amount of vacuum residuum cracking and overall yield of liquid hydrocarbons are controlled by downstream injection of vacuum residuum into the riser.

10 Claims, 14 Drawing Figures

LEGEND

○ VGO ONLY TO BASE OF RISER

◇ VGO AND VACUUM RESID TO BASE OF RISER

△ VGO TO BASE AND VACUUM RESID TO 90 VOL. % OF RISER

□ VGO TO BASE AND VACUUM RESID TO 10 VOL. % OF RISER

FF FRESH FEED

FLUID CATALYTIC CRACKING OF VACUUM RESIDUUM OIL

BACKGROUND OF THE INVENTION

1. Field of the Invention

The invention relates to the fluidized catalytic cracking of vacuum residuum oil. More particularly, the invention relates to cracking vacuum residuum for a short contact time to produce a gasoline and lighter boiling fraction. This is accomplished by diluting the vacuum residuum with a cracked gas oil fraction.

2. Description of Other Related Methods in the Field

The cracking of a hydrocarbon by first injecting a clean gas oil, then dirtier gas oils at points along the reaction zone is shown in U.S. Pat. No. 2,908,630. This method of multiple injection was extended to the residual oil range in U.S. Pat. No. 3,193,494. In that patent a residual oil containing as much as 15 ppm by weight of nickel and 30 ppm by weight of vanadium was injected as the last component of a three component system. The first component was gas oil comprising 50–99% of the total feed and the second component was a heavier gas oil boiling from about 650°–950° F. The concentration of the residual oil was about one-tenth that of the first gas oil injected or 5–10% of the total feed. The use of diluents such as steam, nitrogen and hydrocarbons with boiling points less than about 430° F. to improve the gasoline selectivity is shown in U.S. Pat. Nos. 3,617,496 and 3,617,497. U.S. Pat. No. 3,617,497 discusses cracking a gas oil by injecting a low molecular weight portion of the gas oil to the bottom of a riser and a separate higher molecular weight portion of the gas oil to the upper portion of a riser. Two articles describe a downstream injection system: Bryson, M. C. and Huling, G. P., *Gulf Explores Riser Cracking,* Hydrocarbon Processing, May, 1972, and Campagna, R. J. and Krishna, A. S., *Advances in Resid Cracking Technology,* Katalistiks Fifth Fluid Catalytic Cracking Symposium, May 22–23, 1984. The first of these articles utilizes the teaching of U.S. Pat. No. 3,617,497 and deals with conversion from bed cracking to riser cracking. The second article discusses vacuum gas oil (VGO) cracking and the use of alternate injection points to shift the gasoline/distillate ratio. The article states that the method causes a decrease in gasoline octane.

BRIEF SUMMARY OF THE INVENTION

The present invention is an improvement in a fluidized catalytic cracking process for converting a vacuum residuum fraction to a gasoline and lighter boiling fraction. In the improved process, a vacuum gas oil is contacted with regenerated cracking catalyst to form a first suspension in an initial portion of a riser conversion zone for a total contacting time of 0.5 to 1.5 seconds at hydrocarbon conversion conditions. In a downstream portion of the riser conversion zone, the first suspension is contacted with a vacuum residuum fraction to form a second suspension for a contacting time of 0.2 to 0.6 seconds at hydrocarbon conversion conditions. As a result of contacting at conversion conditions, the vacuum residuum fraction and vacuum gas oil are cracked to hydrocarbon conversion products in the gasoline boiling range and lighter and carbonaceous contaminants are deposited on the catalyst. These hydrocarbon conversion products are separated from the catalyst which is passed to a catalyst regeneration zone. In the catalyst regeneration zone, catalyst temperature is raised to about 1200° F. to 1400° F. by oxidation of the deposited carbonaceous contaminants. Contaminants on catalyst are reduced to 0.1 wt % or less based on carbon. Regenerated catalyst is passed to the riser conversion zone.

DETAILED DESCRIPTION OF THE DRAWINGS

Figure 1:
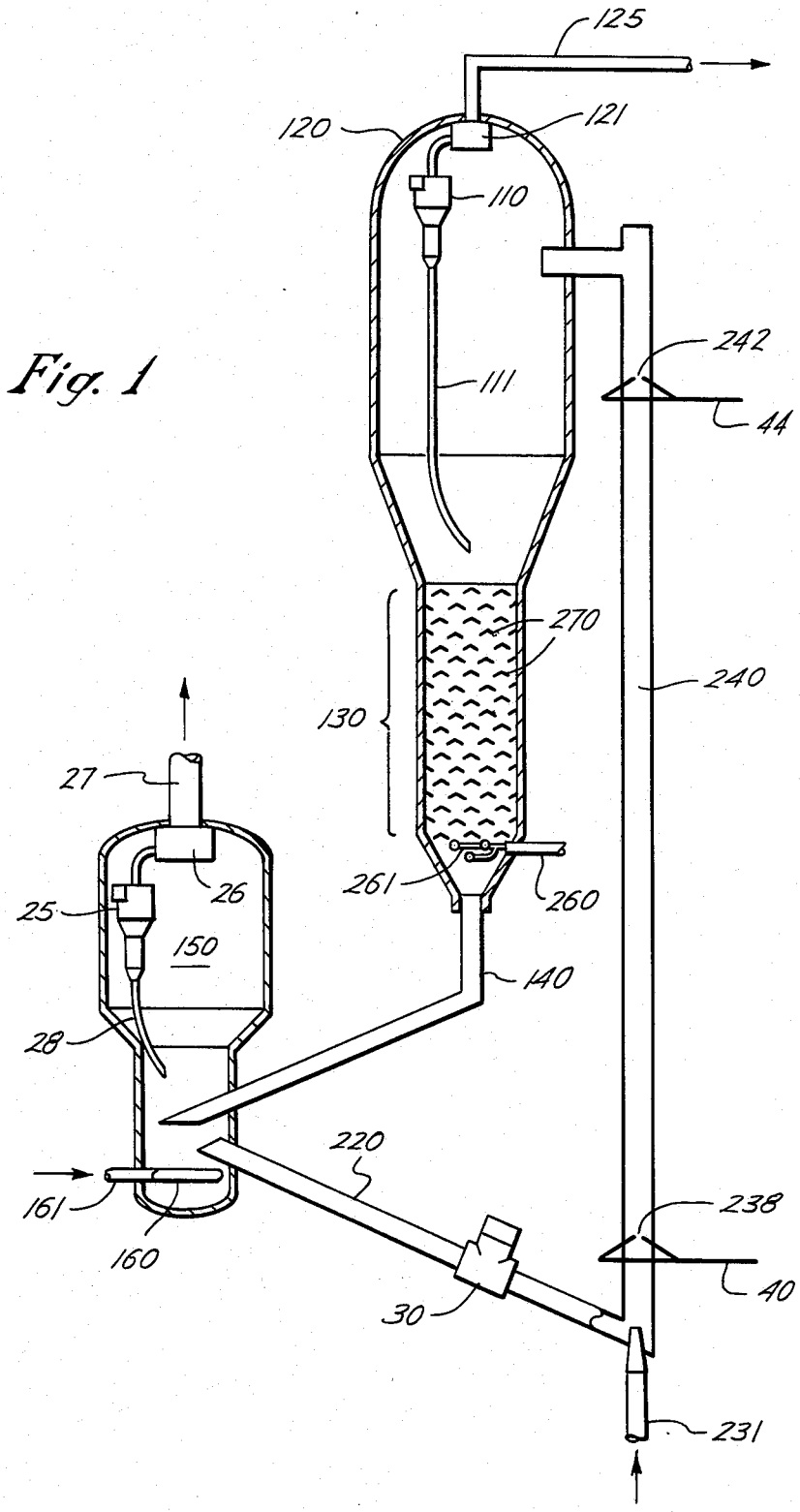
FIG. 1 is a diagramatic arrangement of a fluid catalytic cracking process comprising a riser reactor, catalyst separator and regenerator.

An illustration of the process of this invention is shown in FIG. 1. A clean, freshly regenerated catalyst is delivered by regenerated catalyst standpipe 220 into the initial or lower portion of riser reactor 240. The regenerated catalyst has a carbon content less than about 0.1 wt % and an ASTM microactivity of 60–70. As the catalyst enters the riser, its temperature is decreased from 1300°–1400° F. by the addition of a fluidization medium delivered by line 231. The fluidization medium may be steam, nitrogen or low molecular weight hydrocarbons such as methane, ethane or ethylene. The amount of fluidization medium must be sufficient to fluidize the fluid zeolite catalyst in the base of riser 240 above the minimum fluidization velocity to move the catalyst toward lower injection point 238 for the hydrocarbon oil. Vacuum gas oil (VGO) having a boiling range of about 400°–1000° F. is heated and delivered to the injection point through conduit 40. The VGO enters the riser by way of a first injection nozzle (not shown) which may be a single nozzle or an arrangement of more than one nozzle which mixes oil and catalyst quickly and completely after injection. The amount of catalyst circulated must be enough to completely vaporize the oil and be sufficient to crack the oil to a slate of products containing gases, low boiling liquids and the desirable liquids of gasoline and light cycle gas oil. The mixture of products and unconverted gas oil vapor have sufficient velocity to transport the fluid catalyst through the riser 240 to the upper feed injection point 242 in a downstream portion of the riser 240. Residual oil (vacuum residuum fraction) having an initial boiling point of about 1000° F. and containing therein contaminants such as carbon residue, nitrogen, nickel, vanadium and sodium is delivered to injection point 242 by way of conduit 44 and second injection nozzle (not shown). The contaminants in the vacuum resid are typically 1-20 wt % carbon residue; 1-50 ppm Ni; 1-100 ppm V; 1-10 ppm Na and 100-5000 ppm nitrogen.

The vacuum residuum is heated before delivery to the injection nozzle by preheating or by taking hot material directly from fractionation. The vacuum resid is quickly and thoroughly mixed with the catalyst and oil vapors already present in the reaction zone. Injection of the vacuum residuum at the upper injection point 242 cools the reaction zone reducing further cracking of the VGO. Quenching reduces the undesirable overreaction of the primary products from VGO cracking; gasoline and light cycle gas oil. By reducing overreaction, high yields of the primary products are preserved. The vacuum residuum also undergoes some reaction to products boiling below about 1000° F. The contaminants from the vacuum resid deposit on the catalyst as both temporary and permanent poisons. Carbon residue deposits as coke on the catalyst, which is removed by oxidation in the regenerator. The nickel, vanadium and sodium deposit as permanent poisons and some nitrogen deposits as a temporary poison. The delayed injection of these contaminants with the vacuum resid allows selective cracking of the VGO on freshly regenerated catalyst. It is thought that the vacuum residuum undergoes a minimum of cracking but cracking is increased by recycling some of the product material boiling above about 670° F.

The mixture of catalyst and oil vapors proceed along riser 240 to separator 120. The riser conversion zone comprises the internal volume of the riser from the lower injection point 238 to the separator 120. The oil vapors are removed from the separator 120 through cyclones 110 and plenum 121 and are delivered through a conduit 125 to fractionation and purification means. Entrained catalyst is separated in cyclone 110 and falls to a lower portion of the separator 120 through diplegs 111. The diplegs are sealed by, for example, J-valves, trickle valves, flapper valves, etc.

The catalyst flows into the stripping zone 130 containing baffles 270 or other means to contact the catalyst and stripping medium. The stripping medium may be nitrogen, steam or other suitable material delivered by conduit 260 to distributor 261. Distributor 261 uniformly disperses the stripping medium into the stripping zone 130 and removes entrained hydrocarbons. The hydrocarbons stripped from the catalyst and stripping medium exit with the product vapors through cyclones 110.

The stripped catalyst leaves stripping zone 130 and is delivered to the regenerator 150 by way of standpipe 140. The catalyst is uniformly distributed into the regenerator to facilitate the removal of coke deposited on the catalyst in the reaction zone.

The regenerator 150 contains a dense phase bed of catalyst and a dilute phase of catalyst. Most of the coke is removed in the dense phase bed. A combustion medium of air or oxygen and nitrogen is delivered by conduit 161 to a distribution device 160 to mix combustion medium and coked catalyst. Coke is burned from the catalyst to give a flue gas containing amounts of $CO_2$, $SO_2$, $SO_3$ and $NO_X$. The combustion of the coke to $CO_2$ is preferably carried out at a regenerator temperature at least about 1200° F. but less than about 1400° F. in the presence of a combustion promoter such as platinum so that 0.1 wt % or less residual carbon is left on the catalyst. The flue gas passes through the regenerator dilute phase, cyclones 25, plenum 26 and flue gas line 27 for further processing. As the flue gas passes through the cyclones, catalyst is separated and returned to the dense bed by way of diplegs 28. The regenerated catalyst flows from the dense bed to standpipe 220. Slide valve 30 regulates the flow of regenerated catalyst from standpipe 220 to riser 240.

FIGS. 2-14 are discussed in the Example.

DETAILED DESCRIPTION OF THE PREFERRED EMBODIMENTS

This invention concerns the cracking of a vacuum residuum fraction to gasoline and lighter products in the presence of a fluid cracking catalyst at temperatures in the range of 900° F. to 1100° F.

When hydrocarbon fractions are catalytically cracked, the most desirable products are debutanized gasoline with an end point of about 430° F. and light cycle gas oil boiling from about 430° F. to about 670° F. When residual oil hydrocarbon fractions; boiling at 1000° F.+, are added to a gas oil hydrocarbon fraction; boiling at 430° F. to 1000° F., and charged to the base of the riser reaction zone, the yields of gasoline are substantially less than the gasoline yield from gas oil alone. A new method of cracking the residual oil with gas oil has been found. In the method a gas oil fraction is charged to the base of the riser reaction zone while a residual oil hydrocarbon fraction is charged to the last 10 to 20 vol % of the riser reaction zone. We have discovered that an unexpected advantage results from this downstream injection of residual oil.

Residual oil mixed with VGO and charged to the base of the reaction zone causes large amounts of carbon to deposit on the catalyst which blocks catalyst pores. This carbon deposition prevents VGO from reaching active sites of the fluid zeolite catalyst. The result is a decrease in conversion and gasoline yield from the VGO. In contrast, charging the residual oil to not more than the final 20 vol % of the reaction zone allows the VGO portion of the feed to crack on regenerated catalyst which contains less than 0.1 wt % carbon. The regenerated catalyst temperature is maintained at 1300° to 1400° F. such that the catalyst circulation rate needed to reach riser outlet temperatures of 900° F. and higher is less than would be needed if the regenerator were maintained at less than 1300° F. The VGO and catalyst travel through at least 80 vol % and preferably 80 to 90 vol % of the reaction zone to a point where the residual oil is injected. The residual oil quenches the reaction of the VGO and prevents secondary cracking of the primary product to lighter compounds by quickly lowering the reaction temperature. Carbon contained in the residual oil quickly deposits on the catalyst, blocking the pores and decreasing the rate of the cracking reactions. The more easily cracked molecules in the residual oil crack in this short contact time without undergoing secondary cracking to light hydrocarbons. Data show that coke make is not reduced by this downstream injection of the residual oil; however, dry gas make is reduced. The increase in coke make; expressed as wt % of fresh feed, for this method of residual oil processing versus neat VGO processing at constant conversion is less than the increase in the carbon residue content of the feed resulting from the addition of high carbon residue content residual oil. The increase in coke make is also independent of the residence time of the residual oil. In order to take full advantage of the downstream injection of the residual oil, the regenerator must be operated in a complete combustion mode. The flue gas exiting the regenerator should contain less than 0.5 vol % carbon monoxide and the regenerated catalyst must contain less than 0.1 wt % carbon. In order that more residual oil may be processed in those cases where the regenerator metallurgy is limiting, water may be added to the feed to remove additional heat from the regenerator by vaporization of the water.

The catalyst employed in the present invention comprises a large pore crystalline aluminosilicate customarily referred to as zeolite and an active metal oxide, as exemplified by silica-alumina gel or clay. The zeolites employed as cracking catalysts herein possess ordered rigid three-dimensional structures having uniform pore diameters within the range of from about 5 to about 15 Angstroms. The crystalline zeolitic catalysts employed herein comprise about 1 to 25 wt % zeolite, about 10 to 50 wt % alumina and the remainder silica. Among the preferred zeolites are those known as X type zeolite and Y type zeolite wherein at least a substantial portion of the alkali metal ions from the original preparation have been replaced with such cations as hydrogen and/or metal or combinations of metals such as barium, calcium, magnesium, manganese or rare earth metals.

In the event that metals contamination of the catalyst severely reduces the activity of the catalyst or substantially increases dry gas make, equilibrium or fresh cracking catalyst should be flushed through the unit daily to maintain the desired activity and reduce the dry gas make. Dry gas production and activity loss is minimized by passivation of the metals using passivators available in the industry or by the use of higher than normal dispersion or fluidization steam rates.

The invention is distinguished from the prior art by the injection of the vacuum residuum fraction in the last 10 to 20 vol % of the riser. This process requires complete combustion of the coke to carbon dioxide with excess oxygen and less than 0.5 vol % carbon monoxide in the regenerator flue gas such that the regenerated catalyst carries less than 0.1 wt % carbon. Regenerator temperature should be maintained above 1300° F. such that catalyst circulation and catalyst-to-oil ratio can be kept low. The riser outlet temperature should be maintained above 900° F. preferably 900° F. to 975° F. such that the VGO, in the reaction zone before the residual oil is injected, will react at temperatures between 1000° F. and 1200° F. Contrary to the teaching of the prior art, injection of a diluent vapor to reduce partial pressure of the hydrocarbons was found to be unnecessary unless water injection is used to reduce regenerator temperature.

A 1000+° F. residual oil is cracked with vacuum gas oil to produce a gasoline and lighter boiling fraction. We have found that the residual oil should be injected at a point in the riser such that the residence time is maintained between 0.25 and 0.6 seconds, preferably between 0.4 and 0.5 seconds.

The relative amounts of vacuum resid to the total hydrocarbon feed was not found to be critical. The characteristics of the individual vacuum resid feedstock defines the amount that can be charged. About 5 to 20 wt % of the total hydrocarbon feedstock can be vacuum resid with 10 to 15 wt % being the preferred range as shown in runs 8–10 of the data.

Paraffinic resids yield less desirable products. They also run hotter which results in overcracking to gaseous products. Highly paraffinic resids are limited to 5 wt % of the total hydrocarbon feedstock with the exact amount determined by demand and downstream capacity. Aromatic resids produce a larger amount of the more desirable liquid hydrocarbon products. Aromatic resids may be employed in an amount of up to 20 wt %.

Carbon content of the vacuum resid is also a controlling variable. Resids with larger amounts of carbon contaminants coke catalyst to a greater degree and are best injected further down stream, to 10 vol % or less of the riser. Cleaner vacuum resids can be injected in 10 vol % up to 20 vol % of the riser. The injection of carbon containing resids changes the heat balance of the process. High carbon contamination coking catalyst may dictate the backing out of resid to the lower 5 wt % limit to keep regenerator temperature within the upper 1400° F. limit. Less carbon contaminated resids are injected to the full 20 vol % of the riser to take full advantage of the quenching of the gas oil cracking.

Researchers have recognized that the fluid catalytic cracking of the residual oil results in high slurry oil and high coke yields but they have not addressed the major loss of debutanized (DB) naphtha yield and quality. Our invention, while producing higher coke yields and a slightly higher slurry oil yield, produces only a slight decrease in debutanized (DB) naphtha yield and a slight increase in DB naphtha octane. The unexpected result is that the FCCU produces the same number of octane barrels of material when cracking the vacuum resid as when cracking the vacuum gas oil alone.

EXAMPLE

A series of test runs was conducted on a 5-BPD fluid catalytic cracking pilot unit using an equilibrium fluid zeolite cracking catalyst with the properties shown in Table I. In the test runs, a normal 600° to 1000° F. vacuum gas oil and a 1000+° F. vacuum residuum were charged to equilibrium catalyst. A fresh fluid zeolite catalyst having the properties shown in Table I was continuously added during the runs to maintain the activity of the equilibrium catalyst. The properties of the vacuum gas oil and vacuum residuum are shown in Table II.

The unit was operated at the conditions shown in Table III which resulted in the product yields and qualities shown. In addition to those conditions shown in Table III, a number of operating conditions were held constant throughout the series of test runs. These constant conditions were:

| | | |
|---|---|---|
| Reactor Pressure | 25 | psig |
| Regenerator Flue Gas $O_2$ | 3 | vol % |
| Carbon on Regenerated Catalyst | 0.1 | wt % |
| Fluidization Steam | 0.16 | lb moles/bbl fresh feed |
| Fluidization Nitrogen | 0.58 | lb moles/bbl fresh feed |

Runs 1–3 provided base data in which VGO alone was cracked to give a high yield of debutanized (DB) naphtha. Runs 4 and 5 were the results of adding 1000+F. vacuum resid to the base of the riser. Runs 6 to 10 were the result of adding 1000+° F. vacuum resid to points down the riser from the base so that the resid contacted about 90% of the riser volume in runs 6 and 7 and 10% of the riser volume in runs 8, 9 and 10.

Figure 2:
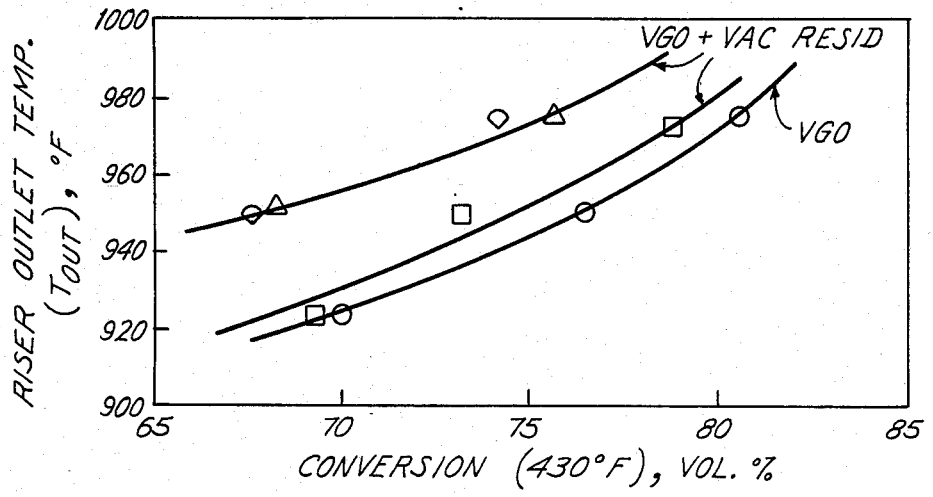
FIG. 2 is a graphical presentation of the relationship between riser outlet temperature and conversion.
Figure 3:
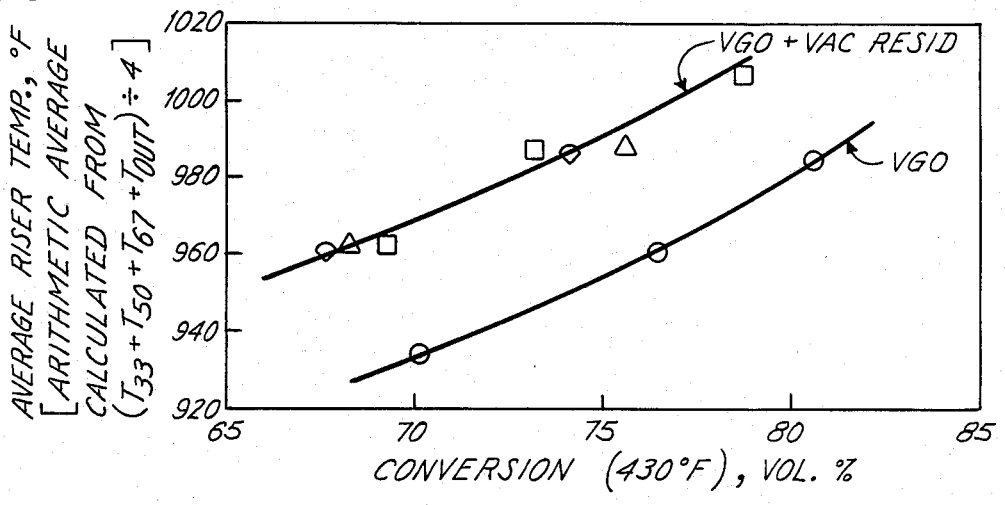
FIG. 3 is a graphical presentation of conversion related to average riser temperature.
Figure 4:
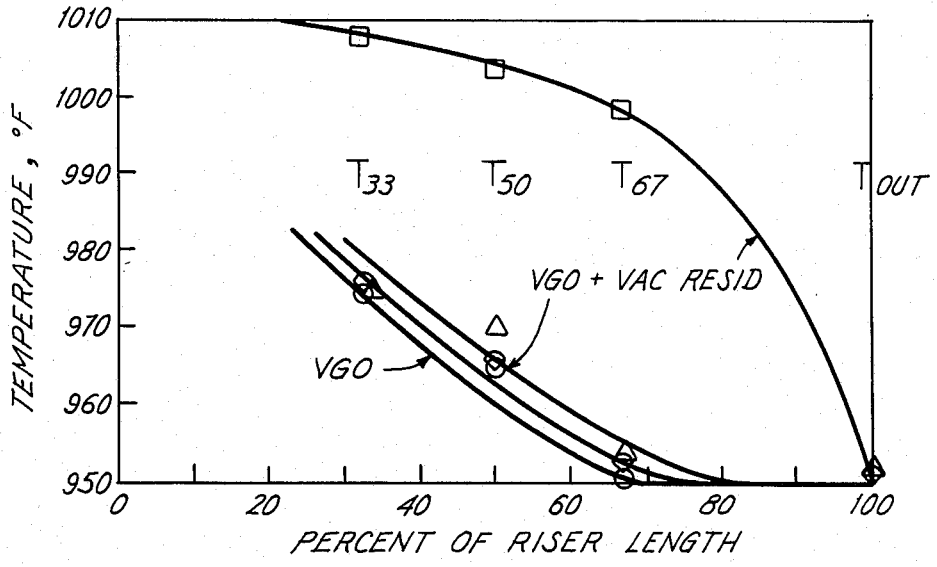
FIG. 4 is a graphical presentation of the temperature profile along the riser for different vacuum residuum injection points.
Figure 5:
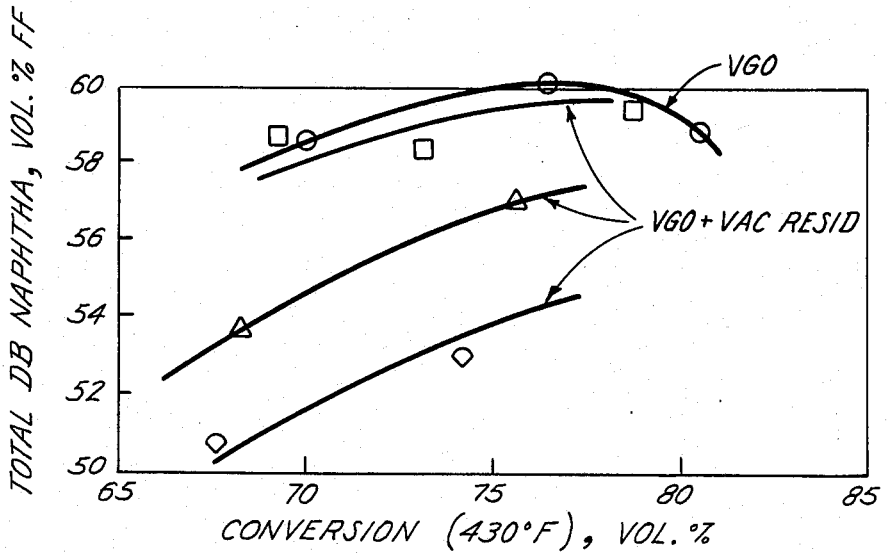
FIGS. 5 and 6 are graphical representations of the naphtha and dry gas yields from cracked vacuum residuum.
Figure 6:
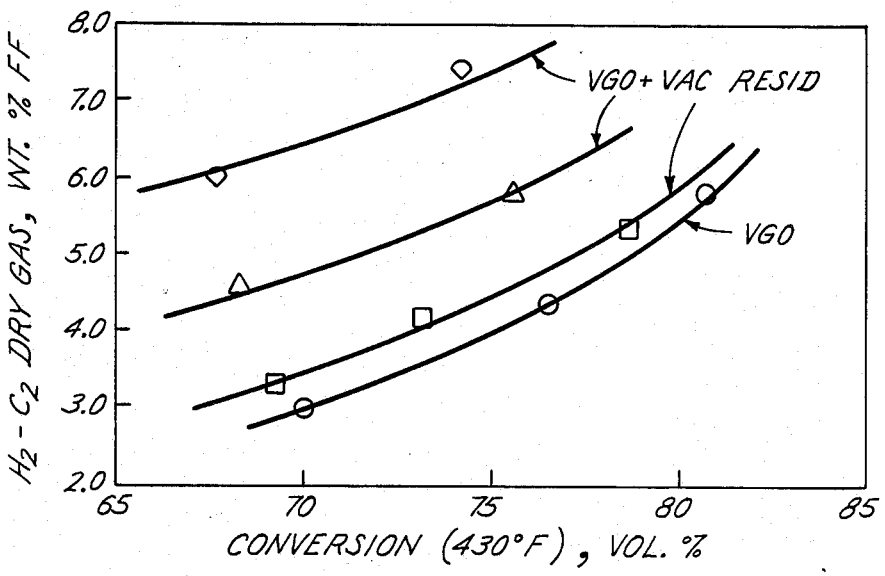
Figure 7:
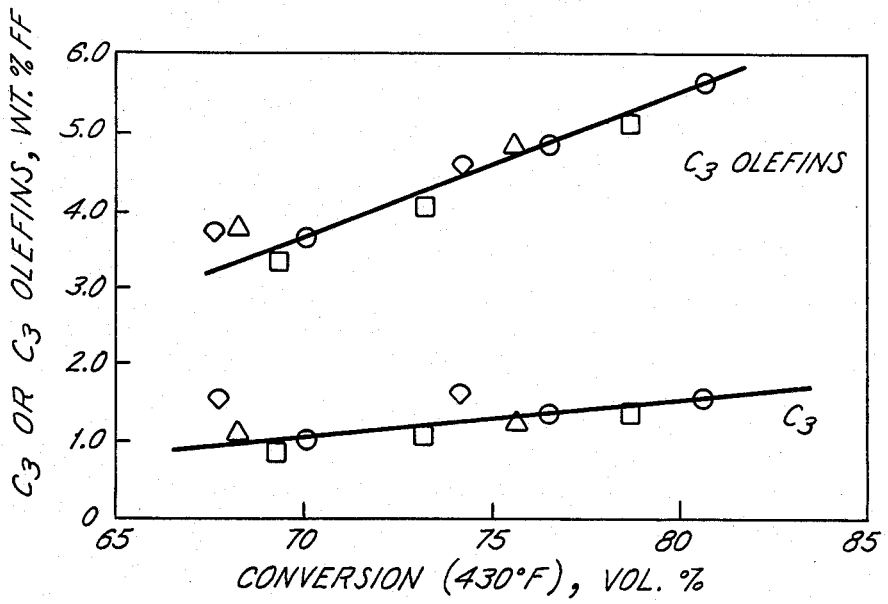
FIGS. 7–9 are a graphical representation of the $C_3$–$C_4$ yields from cracked vacuum residuum.
Figure 8:
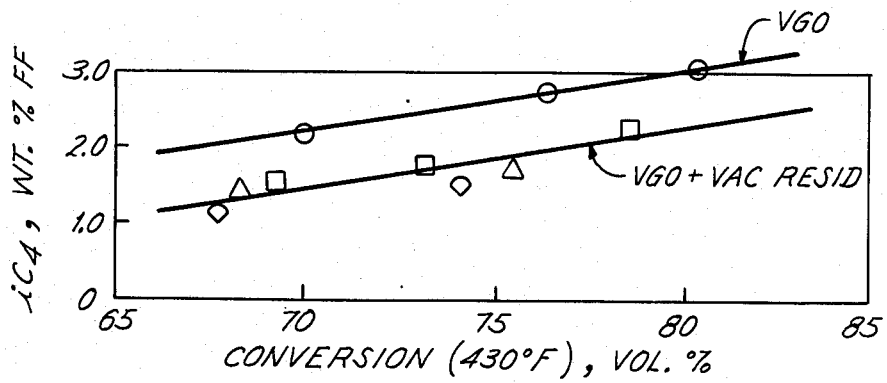
Figure 9:
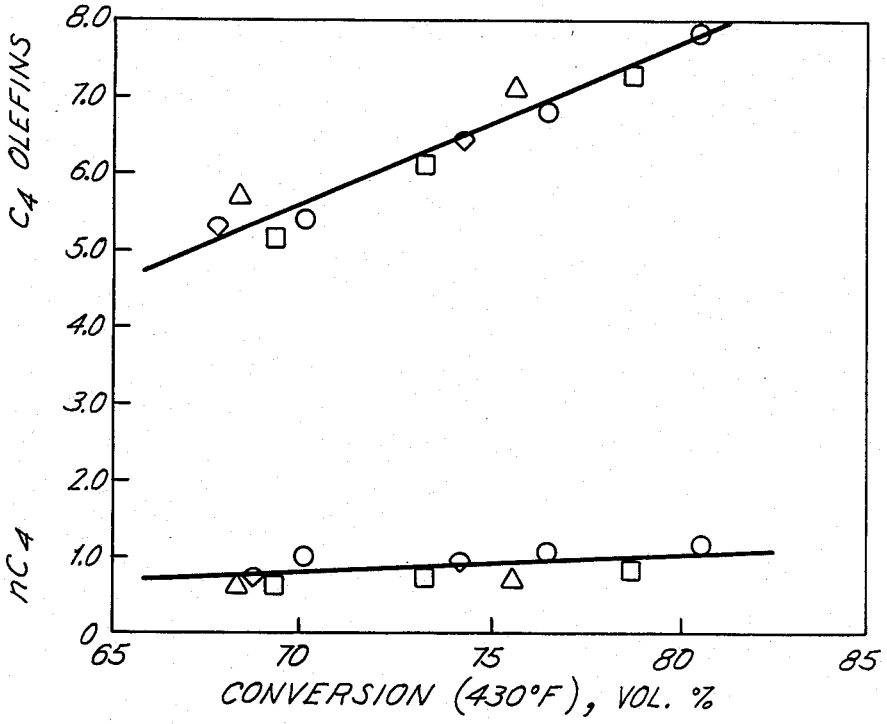
Figure 10:
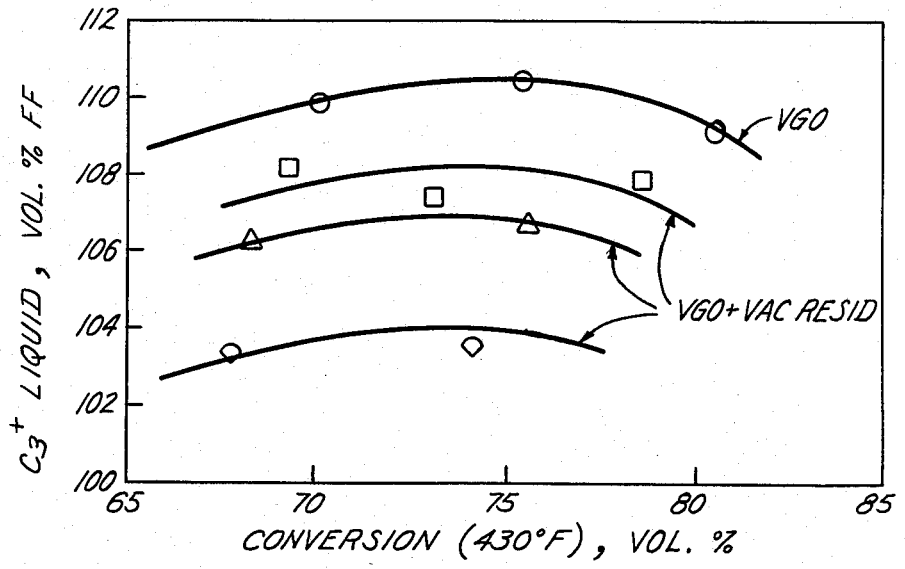
FIGS. 10 and 11 are graphical representation of the $C_3$ plus liquids and naphtha plus light cycle gas oil yields from cracked vacuum residuum.
Figure 11:
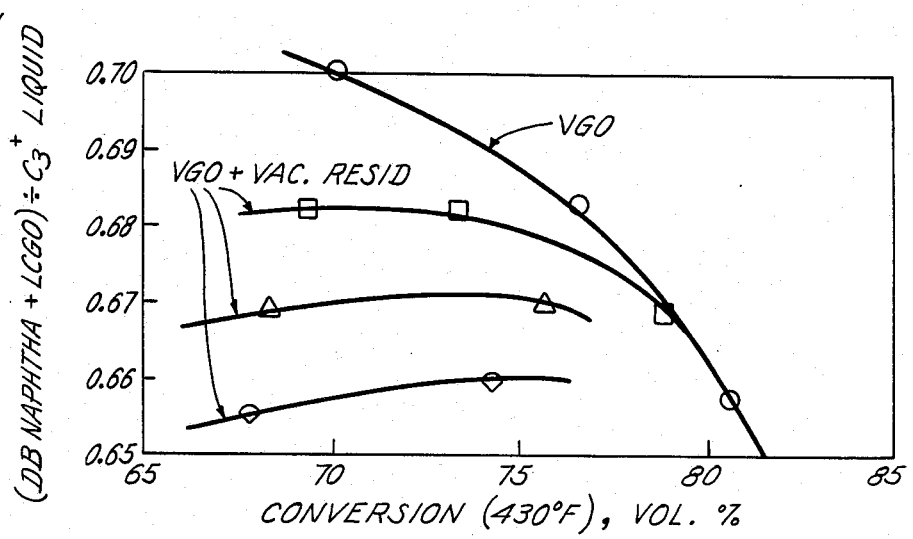

FIGS. 2 to 14 report the results from this series of test runs. FIG. 2 is the normal relationship of riser outlet temperature to conversion. FIG. 3 shows conversion related to average riser temperature. The average riser temperature used was the arithmetic average of four temperatures measured at points approximately 33, 50 and 67% along the riser length and at the riser outlet. The riser was of constant diameter along its length. Of particular note is that the relation between average riser temperature and conversion is not affected by the point where the resid is injected. FIG. 4 reports the temperature profiles through the riser which were observed from the 950° F. riser outlet temperature run from each of the resid injection points. The temperature profiles indicate that injecting the resid at the point which allowed only 10% of the riser to be contacted by the resid allowed the vacuum gas oil to react at a very high riser temperature. The curve in FIG. 5 for 100% VGO feed shows that these temperatures resulted in a low yield of DB naphtha because of secondary reaction of the naphtha to undesired products. FIGS. 5 and 6 show that the normal injection of resid with the fresh feed at the riser base reduced the naphtha yield with a corresponding, though not equivalent, increase in dry gas. Reducing the riser length used to react the resid increased the DB naphtha yield while reducing the dry gas. FIGS. 7 to 9 show that of the $C_3$–$C_4$ yields, only the $iC_4$ was reduced as the resid was injected. The slight $iC_4$ reduction was observed regardless of the resid injection point. FIG. 10 shows that injecting the resid downstream from the VGO resulted in a higher volume yield of $C_3$ plus liquid than when the resid was added to the VGO feed at the base of the riser. FIG. 11 shows that the portion of the $C_3$ plus material which is naphtha and light cycle gas oil-LCGO (650° F. ASTM end point) also increased when the resid was injected downstream from the VGO.

Figure 12:
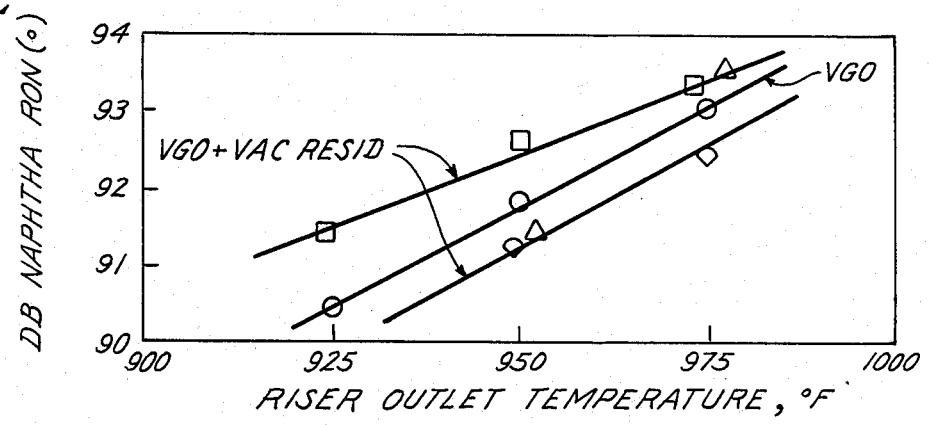
FIGS. 12 and 13 are a graphical representation of the quality of naphtha produced from cracked vacuum residuum.
Figure 13:
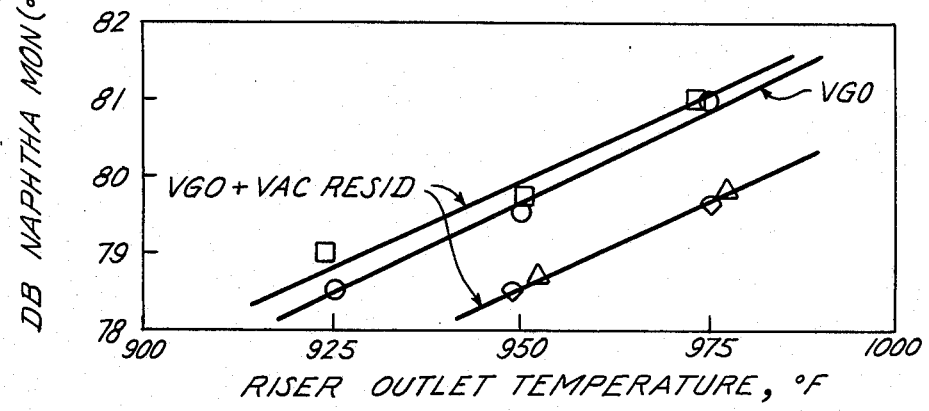
Figure 14:
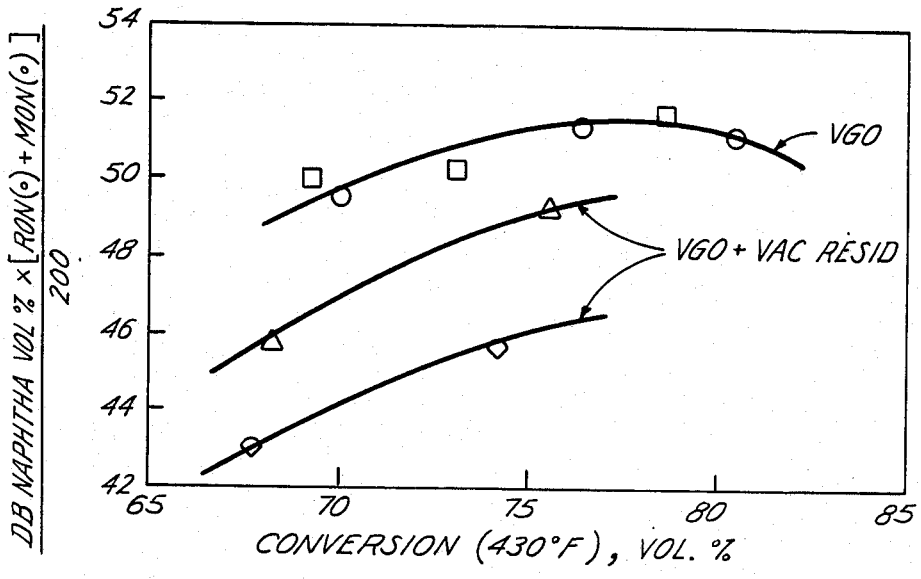
FIG. 14 is a graphical representation of octane barrel production from vacuum residuum cracking.

The quality of the DB naphtha is shown in FIGS. 12 and 13. The results show that resid injected near the riser outlet produces a naphtha having higher RON and MON than when the resid was injected with the VGO feed or slightly downstream of the VGO feed. The RON and MON were even higher with resid added than when VGO was cracked alone. The most significant result of injecting the resid near the riser outlet is shown in FIG. 14. Allowing the VGO to react through 90 vol % of the riser before injecting resid allowed the same amount of octane barrel production per barrel of hydrocarbon feed as obtained with VGO cracking alone. This means that octane barrels were produced as efficiently from the resid as from the VGO.

TABLE I

INSPECTION TESTS ON CATALYST*

| | EQUILIBRIUM | FRESH |
|---|---|---|
| METALS ON CATALYST | | |
| Cu WPPM | 77 | 13 |
| Ni | 4577 | 11 |
| Fe | 6300 | 3400 |
| Cr | 657 | 667 |
| V | 965 | 63 |
| Na (WT %) | 0.78 | 0.68 |
| ACTIVITY (D + L)** | 57 | 65 |
| SURFACE AREA ($M^2$/gm) | 104 | 288 |
| DENSITY (lb/$ft^3$) Compacted | 58.9 | 53.6 |
| PARTICLE SIZE (micron) | | |
| 0–10 | 2 | 4 |
| 20–40 | 22 | 20 |
| 40–80 | 55 | 53 |
| 80+ | 21 | 23 |
| AVERAGE | 62 | 63 |
| PORE VOLUME, cc/gram | 0.36 | 0.48 |

*Filtrol ® ROC-1

**Catalyst activity for cracking VGO, Distillate and Losses Bench Scale Method For Determining Activity of Cracking Catalyst In Powdered Form, H. McReynolds, Paper at API 25th Annual Meeting, Nov. 10, 1947

TABLE II

INSPECTION TESTS ON CHARGESTOCKS

| DESCRIPTION | VGO-1 | VACUUM RESID |
|---|---|---|
| GRAVITY, API | 24.8 | 9.8 |
| DISTILLATION, °F. | | |
| IBP/5 | 593/672 | 1000+ |
| 10/20 | 685/708 | |
| 30/40 | 721/735 | |
| 50 | 749 | |
| 60/70 | 760+/ | |
| 80/90 | | |
| 35/EP | | |
| VISCOSITY, cSt AT 76.7° C. | 16.54 | 4728 |
| AT 100° C. | 8.49 | 273 |
| POUR, °F., ASTM UPPER | 90 | 120 |
| SULFUR, WT % | 0.42 | 1.41 |
| TOTAL NITROGEN, WPPM | 800 | 4800 |
| ANILINE PT, °F. | 204 | — |
| BROMINE NUMBER | 1.6 | — |
| AROMATICS, WT % | 37.4 | — |
| $nC_5$ INSOLUBLES, WT % | 0.0 | 8.42 |
| CARBON RESIDUE, WT % | 0.75 | 14.4 |
| ASH, WT % | 0 | 0.02 |
| METALS, X-RAY, WPPM Ni, V | <1, <1 | 28,71 |
| Fe, Cu | 1,0 | 32,8 |
| Cr | 0 | 2 |
| SODIUM, WPPM | <1 | 30 |

TABLE III

ALTERNATE INJECTION POINTS FOR VACUUM RESID

| | RUN NO. | | | | | | | | | |
|---|---|---|---|---|---|---|---|---|---|---|
| | 1 | 2 | 3 | 4 | 5 | 6 | 7 | 8 | 9 | 10 |
| Test Period | 2808 A/B | 2808 C/D/G/H | 2808 E/F/J/K | 2808 L/M | 2808 P | 2809 C/D/E | 2809 F/G | 2808 V/W | 2808 Y/Z | 2809 A |
| VGO Feed Rate, 1/hr. | 23.4 | 23.7 | 23.9 | 20.9 | 20.6 | 21.0 | 21.3 | 20.9 | 20.5 | 20.8 |
| Resid Feed Rate, 1/hr. | — | — | — | 3.0[1] | 2.9[1] | 3.0[2] | 3.0[2] | 2.9[3] | 3.2[3] | 2.9[3] |
| Riser Outlet Temperature, °F. | 925 | 950 | 975 | 975 | 949 | 977 | 952 | 973 | 950 | 924 |
| Regenerator Temperature, °F. | 1248 | 1258 | 1278 | 1367 | 1365 | 1355 | 1373 | 1364 | 1372 | 1376 |
| Cooling Air, SCFH | — | — | — | (468) | (657) | (48) | (148) | (0) | (190) | (82) |
| VGO Preheat Temperature, °F. | 551 | 551 | 551 | 552 | 549 | 555 | 553 | 558 | 552 | 550 |
| Resid Preheat Temperature, °F. | — | — | — | 552 | 549 | 337 | 313 | 475 | 482 | 479 |
| Riser Temperature, 1st Section | 949 | 974 | 999 | 1003 | 976 | 999 | 975 | 1028 | 1008 | 985 |
| 2nd Section | 938 | 964 | 988 | 992 | 966 | 996 | 970 | 1022 | 1003 | 979 |
| 3rd Section | 926 | 950 | 975 | 976 | 952 | 978 | 954 | 1006 | 986 | 962 |
| Hydrocarbon Yields Wt % of Fresh Feed | | | | | | | | | | |
| $H_2S$ | 0.35 | 0.36 | 0.36 | 0.42 | 0.47 | 0.37 | 0.34 | 0.36 | 0.34 | 0.35 |
| $H_2$—$C_2$ Dry Gas | 3.00 | 4.32 | 5.78 | 7.34 | 5.97 | 5.77 | 4.57 | 5.31 | 4.20 | 3.30 |
| $C_3$= | 3.67 | 4.80 | 5.66 | 4.63 | 3.74 | 4.82 | 3.81 | 5.08 | 4.03 | 3.36 |
| $C_3$ | 0.97 | 1.31 | 1.56 | 1.63 | 1.51 | 1.27 | 1.11 | 1.32 | 1.06 | 0.89 |
| $iC_4$ | 2.17 | 2.72 | 3.00 | 1.49 | 1.15 | 1.70 | 1.45 | 2.24 | 1.72 | 1.52 |

TABLE III-continued

ALTERNATE INJECTION POINTS FOR VACUUM RESID

| | RUN NO. | | | | | | | | | |
|---|---|---|---|---|---|---|---|---|---|---|
| | 1 | 2 | 3 | 4 | 5 | 6 | 7 | 8 | 9 | 10 |
| $nC_4$ | 0.98 | 1.04 | 1.16 | 0.93 | 0.73 | 0.70 | 0.66 | 0.82 | 0.72 | 0.63 |
| $C_4$= | 5.40 | 6.79 | 7.80 | 6.43 | 5.28 | 7.09 | 5.71 | 7.24 | 6.07 | 5.17 |
| Total DB Naptha 430° F. EP | 47.90 | 48.96 | 48.42 | 43.54 | 41.55 | 46.51 | 43.80 | 48.27 | 47.56 | 47.92 |
| LOGO (430–650° F.) | 18.34 | 15.76 | 13.64 | 15.72 | 16.96 | 14.89 | 17.39 | 13.45 | 15.15 | 14.94 |
| HCGO (650° F.+) | 13.06 | 9.37 | 7.66 | 12.26 | 16.87 | 11.19 | 15.58 | 9.91 | 13.42 | 16.27 |
| Coke | 4.17 | 4.57 | 4.97 | 5.62 | 5.77 | 5.69 | 5.57 | 5.99 | 5.73 | 5.65 |
| $C_3$ + Liquid, vol % | 109.8 | 110.4 | 109.1 | 103.6 | 103.4 | 106.8 | 106.3 | 107.9 | 107.4 | 108.2 |
| Conversion, vol % | 70.09 | 76.50 | 80.64 | 74.18 | 67.67 | 75.60 | 68.28 | 78.66 | 73.22 | 69.31 |
| DB Naphtha RON(o)/MON(o) | 90.4/ 78.5 | 91.8/ 79.5 | 93.0/ 81.0 | 92.4/ 79.6 | 91.2/ 78.5 | 93.5/ 79.8 | 91.4/ 78.7 | 93.3/ 81.0 | 92.6/ 79.7 | 91.4/ 79.0 |
| Total DB Naphtha, Vol % of Fresh Feed | 58.62 | 60.03 | 58.78 | 53.02 | 50.73 | 56.93 | 53.74 | 59.28 | 58.42 | 58.67 |
| LCGO, Vol % of Fresh Feed | 18.17 | 15.32 | 13.01 | 15.32 | 17.02 | 14.63 | 17.39 | 12.94 | 14.91 | 15.15 |
| HCGO, Vol % of Fresh Feed | 11.74 | 8.19 | 6.34 | 10.49 | 15.31 | 9.77 | 14.34 | 8.40 | 11.88 | 15.54 |

[1]Base of riser;
[2]vacuum resid to riser at 10% downstream;
[3]vacuum resid to riser at 90% downstream While particular embodiments of the invention have been described, it will be understood that the invention is not limited thereto since modifications may be made and it is therefore contemplated to cover by the appended claims any such modifications as all within the spirit and scope of the claims.

What is claimed is:

1. In a fluid catalytic cracking process comprising a riser conversion zone, a catalyst separation zone and a catalyst regeneration zone, wherein the improvement comprises:

a. contacting a vacuum gas oil with a regenerated cracking catalyst to form a first suspension in an initial portion of said riser conversion zone under elevated temperature hydrocarbon conversion conditions for a contacting time of about 0.5 to 1.5 seconds;

b. contacting the first suspension in a down stream portion of the riser conversion zone with a vacuum residuum fraction to form a second suspension under elevated temperature hydrocarbon conversion conditions for a contacting time of about 0.25 to 0.6 seconds;

c. separating cracking catalyst with deposited contaminants of hydrocarbon conversion from hydrocarbon conversion products of said vacuum gas oil and said vacuum residuum fraction in said catalyst separation zone;

d. regenerating separated cracking catalyst with deposited contaminants of hydrocarbon conversion in said catalyst regeneration zone wherein said catalyst is raised to a temperature of about 1200° to 1400° F. to yield a regenerated cracking catalyst wherein deposited contaminants are reduced to about 0.1 wt % or less.

2. The process of claim 1 wherein the first suspension reaches a temperature of about 1000° to 1200° F. before contacting with said vacuum residuum fraction.

3. The process of claim 1 wherein said second suspension reaches a temperature of about 900° to 975° F. before separating.

4. The process of claim 1 wherein the downstream portion of the riser conversion zone is the last 10 to 20 vol % of the riser conversion zone.

5. The process of claim 1 wherein the relative amount of vacuum residuum fraction to (vacuum residuum fraction+vacuum gas oil) is about 5 to 20 wt %.

6. The process of claim 1 wherein the relative amount of vacuum residuum fraction to (vacuum residuum fraction+vacuum gas oil) is 10 to 15 wt %.

7. A method of cracking a vacuum residuum fraction to produce gasoline and lower boiling products which comprises:

a. contacting a vacuum gas oil with a fluidized cracking catalyst for a contacting time of 0.5 to 1.5 seconds, said cracking catalyst at an initial contacting temperature of about 1000° to 1200° F.;

b. contacting said fluidized cracking catalyst and vacuum gas oil with a vacuum residuum fraction for a contacting time of about 0.2 to 0.6 seconds;

c. separating said cracking catalyst from cracked products of said vacuum residuum fraction and said vacuum gas oil.

8. The method of claim 7 wherein the fluidized cracking catalyst of step a contains less than 0.1 wt % deposited carbon contaminants.

9. The process of claim 7 wherein the relative amount of vacuum residuum fraction to (vacuum residuum fraction+vacuum gas oil) is about 5 of 20 wt %.

10. The process of claim 7 wherein the relative amount of vacuum residuum to (vacuum residuum fraction+vacuum gas oil) is 10 to 15 wt %.

* * * * *